US006241311B1

(12) United States Patent
Zheng

(10) Patent No.: US 6,241,311 B1
(45) Date of Patent: Jun. 5, 2001

(54) SUPPORT RING FOR HOLDING A FABRIC SEAT ON INCLINED FRAME TUBE

(75) Inventor: Edward Zheng, Laverne, CA (US)

(73) Assignee: Tofasco of America, Inc., La Verne, CA (US)

( * ) Notice: Subject to any disclaimer, the term of this patent is extended or adjusted under 35 U.S.C. 154(b) by 0 days.

(21) Appl. No.: 09/363,534

(22) Filed: Jul. 29, 1999

(51) Int. Cl.[7] ..... A47C 4/28
(52) U.S. Cl. ..... 297/45; 297/16.1
(58) Field of Search ..... 297/16.1, 42, 45, 297/56, 463.1, 463.2, 452.18, 452.2, 452.1; 24/713.7

(56) References Cited

U.S. PATENT DOCUMENTS 3,512,224 * 5/1970 Newton .
4,890,362 * 1/1990 Odajima et al. .
5,975,626 * 11/1999 Aycock .
5,984,406 * 11/1999 Lee .
6,045,177 * 4/2000 Grace .

* cited by examiner

*Primary Examiner*—Milton Nelson, Jr.
(74) *Attorney, Agent, or Firm*—Raymond Y. Chan; David and Raymond Patent Group

(57) ABSTRACT

A support ring for holding a fabric seat on an inclined frame tube of a portable chair frame allows the support ring to rest horizontally on the inclined frame tube so as to enable the fabric seat also resting horizontally on the chair frame. The support ring has a supporting hole contributed by two semi-circular portions and an intermediate portion extended between the two semi-circular portions. Each of the semi-circular portions has a diameter equal to or slightly larger than a diameter of the inclined frame tube. The intermediate portion also has a width equal to the diameter of the semi-circular portion. When the inclined frame tube fittingly passes through the supporting hole and is supported inclinedly with the horizontal, the support ring can be horizontally mounted on the inclined frame tube while a lower half of the frame tube resting on an upper edge of one of the semi-circular portion of the supporting hole and an upper half of the frame tube supporting by a lower edge of the another semi-circular portion of the supporting hole. Therefore, the fabric seat can be mounted horizontally on the chair frame and the downwardly force applied on the fabric seat can be evenly distributed and supported around the support ring.

18 Claims, 5 Drawing Sheets

SUPPORT RING FOR HOLDING A FABRIC SEAT ON INCLINED FRAME TUBE

FIELD OF THE PRESENT INVENTION

The present invention relates to fabric made portable seat products, and more particularly, to a support ring for holding a fabric seat on an inclined chair frame tube.

BACKGROUND OF THE PRESENT INVENTION

Portable chair generally consists of a collapsible chair frame constructed by metal tubes, and a chair seat made of durable fabric.

FIG. 1 illustrates a type of portable chair which includes a chair frame A1 which is constructed by a set of interlocking tubes A11 to pvoide a back frame section A2 and a seat frame section A3 for supporting a fabric seat B1. The interlocking tubes A11 of the seat frame A1 are often arranged in inclined manner so that the chair frame A1 can be easily opened to proivde a rigid cross-support for use and be folded up for storage.

The conventional method of attaching the fabric seat B1 to the chair frame A1 is to affix an upper end B2 of the fabric seat B1 to a top end of the back frame section A2 and to have two tube placement holes B11 provided at two front corners of the fabric seat B1 for mounting a front end B3 of the fabric seat B1 on two the seat frame. Each of the placement holes The conventional fabric seat is attached to the seat frame by slipping the tube placement holes over the inclined frame tubes of the seat frame portion of the chair. The seat can then be hooked over the top of the back frame to secure the back of the fabric seat to the frame. This means that at least two tube placement holes on the front portion of the fabric seat for attaching the fabric seat to the front portion of a seat frame are needed for the conventional fabric seat in order to attach the fabric seat to a seat frame.

All typical frame tubes A11, including the two front frame tubes A11*a,* are cylindrical hollow tube and the tube placement holes B11 of the conventional fabric seat B1 are cut in circular shape and to the size of the frame tube A11 as if the fabric seat B1 were resting perpendicular to the frame tube A11. This allows the tube placement hole B11 of the fabric seat B1 to slide onto the inclined frame tube A11 easily and snugly. This conventional design, however, has inherent problems when the chair is used. Since the two front frame tube A11*a* are supported inclinedly and pivotally in cross manner but not in vertical manner, an individual sitting down on the fabric seat B1 causes stress to the lining of the tube placement hole B11 of the fabric seat B1. This causes the tube placement hole B11 to be stretched and misshapen, or worse, torn open, as a pulling pressure is applied to the lining of the tube placement holes B11 as an individual sits on the fabric seat B1.

Conventionally, in order to reinforce the structural integrity of the tube placement hole B11, a circular support ring made of a rigid material, such as metal or hard plastic, can be mounted on the placed within the tube placement hole.

However, since the support ring lining of the tube placement hole B11 is also cylindrical and just wider then the width of frame tube, it merely shifts the point of stress on the fabric seat B1. The circular support ring merely sits perpendicularly to an axis of the frame tube B11. In this situation, if an individual sits down, an angle is created on the fabric seat B1 from the downward pulling force on the fabric seat B1 at the point where the edge of the support ring ends. A person's weight causes the fabric seat B1 to be pulled away from the edge of the support ring. Therefore, the fabric seat B1 at the edge of the support ring is pulled from a stress created at the edge of the support ring. At the same time, the ring itself causes an opposite downward pulling force on the fabric seat B1 at the same stress point. As a result, two things occur. First, the fabric seat B1 will be distorted at the edge of the support ring, creating a pointed ridge at the edge of the support ring. Second, a stress point is created at edge of the support ring where the angle is created.

In other words, the stress on the fabric seat B1 has simply been transferred from the lining of the tube placement hole B11 to a point just off the tube placement hole B11. The stress created will then cause a tear, not at the tube placement hole B11, but along the edge of the support ring. Although additional lining layers B12 may be added to the corners of the fabric seat B1 around the tube placement hole B11 to delay the tearing effect, ultimately the stress will cause the fabric seat B1 to tear. Also, the fabric will be permanently misshapen at the stress point over a period of continued use.

SUMMARY OF THE PRESENT INVENTION

A main object of the present invention is to provide a support ring for the lining of a tube placement hole of a fabric seat for attaching the fabric seat to tube of a chair frame by sliding the support ring over an respective inclined frame tube of the chair frame in a manner as to allow the support ring to rest horizontally on the inclined frame tube so as to enable the fabric seat also resting horizontally on the chair frame.

Another object of the present invention is to provide a support ring for a fabric seat that can evenly distribute the stress around the support ring so as to minimize the deterioration of the tube placement hole of the fabric seat as the portable chair is used.

Another object of the present invention is to provide a support ring for a fabric seat for attaching the fabric seat to a chair frame that limits damage to the area around the tube placement hole of the fabric seat as the portable chair is used.

Another object of the present invention is to provide a support ring that reduces the horizontal strain on the tube placement hole from being pulled against the inclined frame tube by transferring some of the force to vertical pressure by the support ring against the inclined frame tube.

Another object of the present invention is to provide a support ring for a fabric seat, which slides onto the respective inclined frame tube in such a manner as to allow an individual to sit on the fabric seat without distorting the shape of the fabric seat.

Accordingly, in order to accomplish the above objects, the present invention provides a support ring provided on a corner portion of a fabric seat for holding the fabric seat on an inclined frame tube of a chair frame, wherein the inclined frame tube is a round tube arranged to be inclined with respect to the horizontally supported fabric seat. The support ring has a supporting hole contributed by two semi-circular portions and an intermediate portion extended between the two semi-circular portions. Each of the semi-circular portions has a diameter equal to or slightly larger than a diameter of the inclined frame tube. The intermediate portion also has a width equal to the diameter of the semi-circular portion. When the inclined frame tube fittingly passes through the supporting hole and is supported inclinedly with the horizontal, the support ring can be horizontally mounted on the inclined frame tube while a lower half of the frame tube resting on an upper edge of one of the semi-circular portion of the supporting hole and an upper half of the frame tube supporting by a lower edge of the another semi-circular portion of the supporting hole. Therefore, the fabric seat can be mounted horizontally on the chair frame and the downwardly force applied on the fabric seat can be evenly distributed and supported around the support ring.

DETAILED DESCRIPTION OF THE PREFERRED EMBODIMENT

Figure 1:
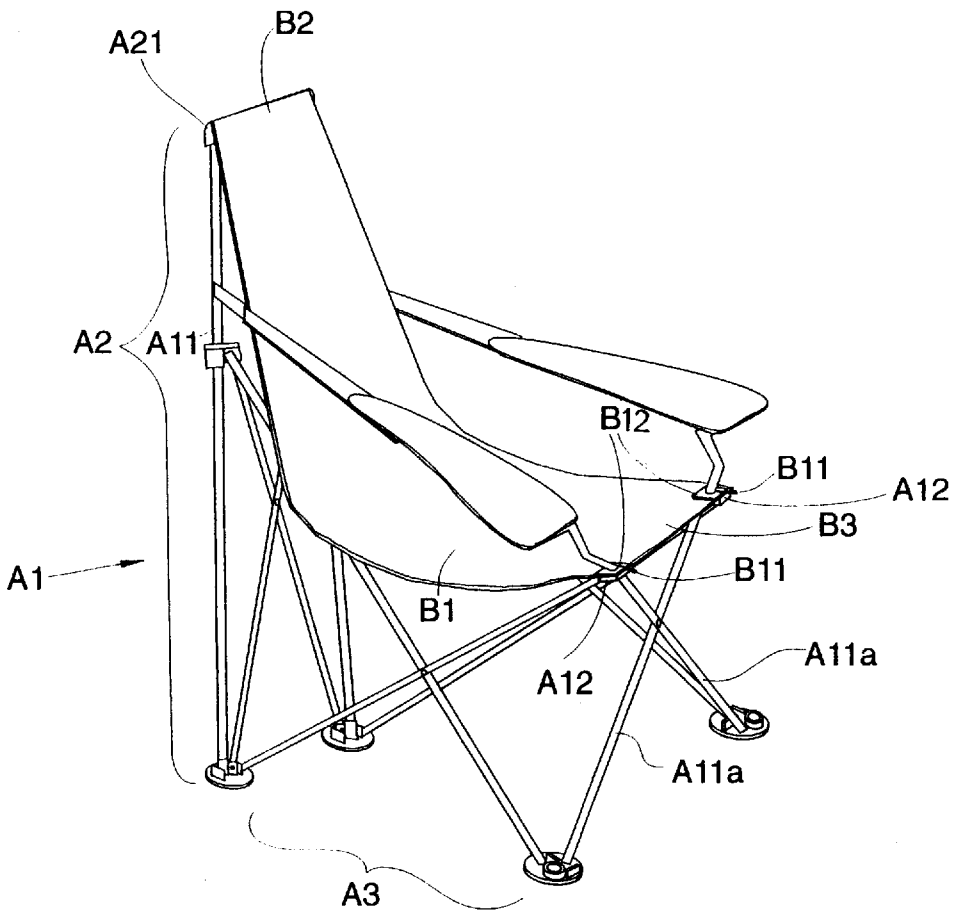
FIG 1 PRIOR ART
FIG. 1 is a perspective view illustrating a conventional collapsible chair.
Figure 2:
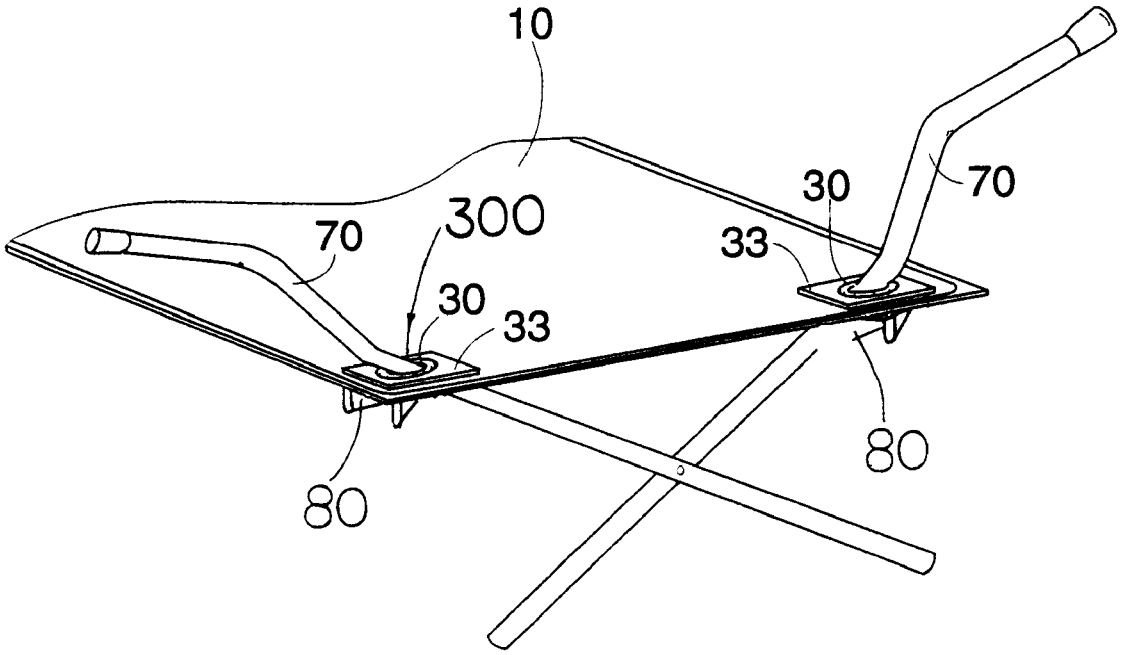
FIG. 2 is a perspective view illustrating part of a collapsible chair comprising a pair of support rings for holding a fabric seat on an inclined chair frame tube according to a preferred embodiment of the present invention.
Figure 3:
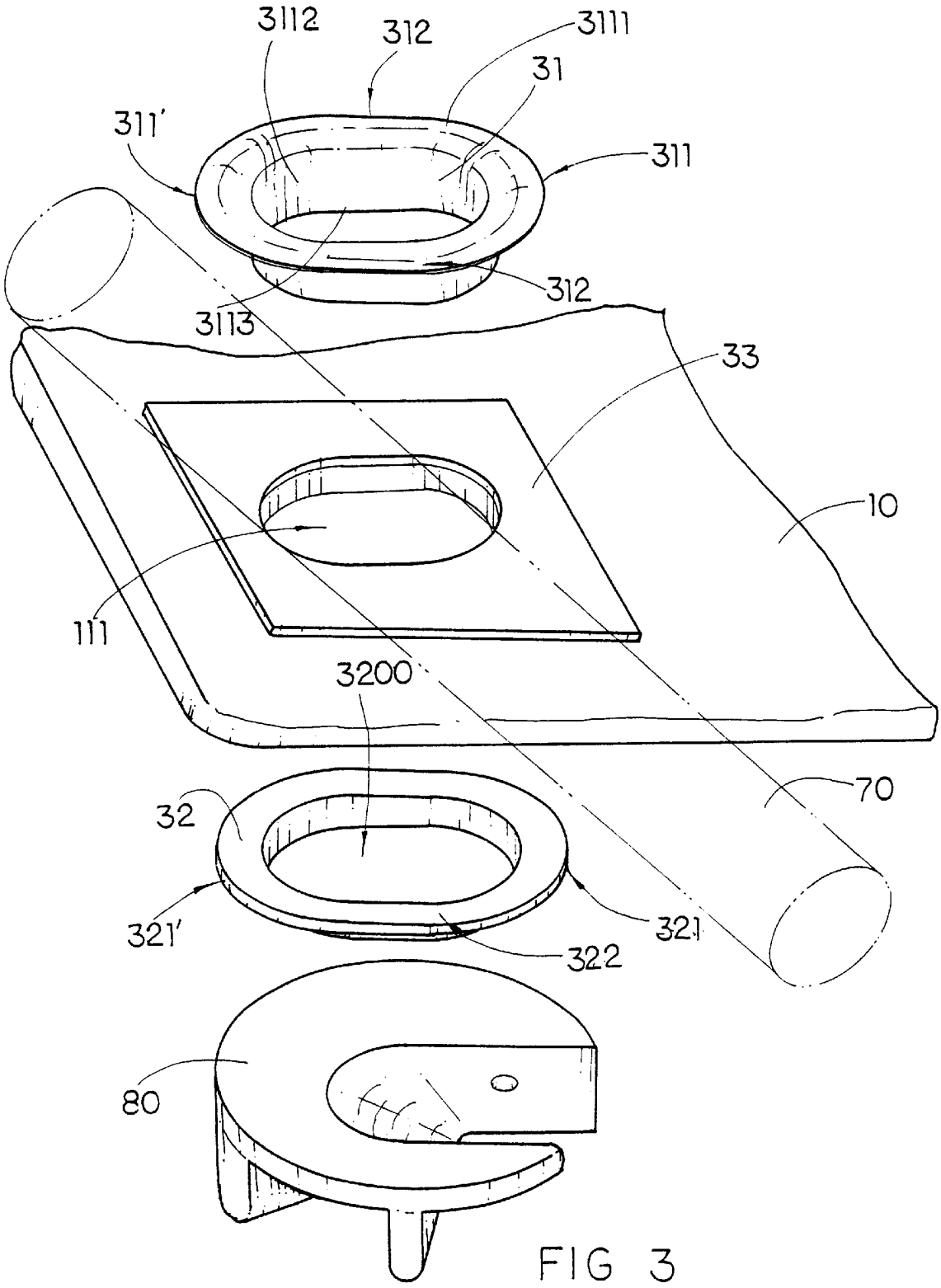
FIG. 3 is an exploded perspective view of the support ring adapted to be mounted on a fabric seat according to the above-preferred embodiment of the present invention.

Referring to FIGS. 2 and 3 with reference to FIG. 1, a collapsible portable chair comprises a fabric seat 10 having two tube placement holes 111 formed at two corners thereof for two inclined frame tubes 70 to penetrate therethrough respectively for supporting the fabric seat 10 in position.

A pair of reinforcing patches 33 made of strong but flexible textile, such as leather, is integrally stitched to two corners of a top surface of the fabric seat 10 around the tube placement hole 111 for reinforcing the structural integrity of the tube placement hole 111.

Referring to FIGS. 2 to 5, the present invention provides a support ring 30 for reinforcing the tube placement hole 111 and adding stiffness and durability to the tube placement hole 111. As shown in FIG. 3, the support ring 30 comprises an oval upper ring member 31 and an oval lower ring member 32. The upper ring member 31 and the lower ring member 32 of the support ring 30 each has a set of identical first and second curved end pieces 311, 311', 321, 321' and two identical side pieces 312, 322 connecting the first and second end pieces.

Figure 4:
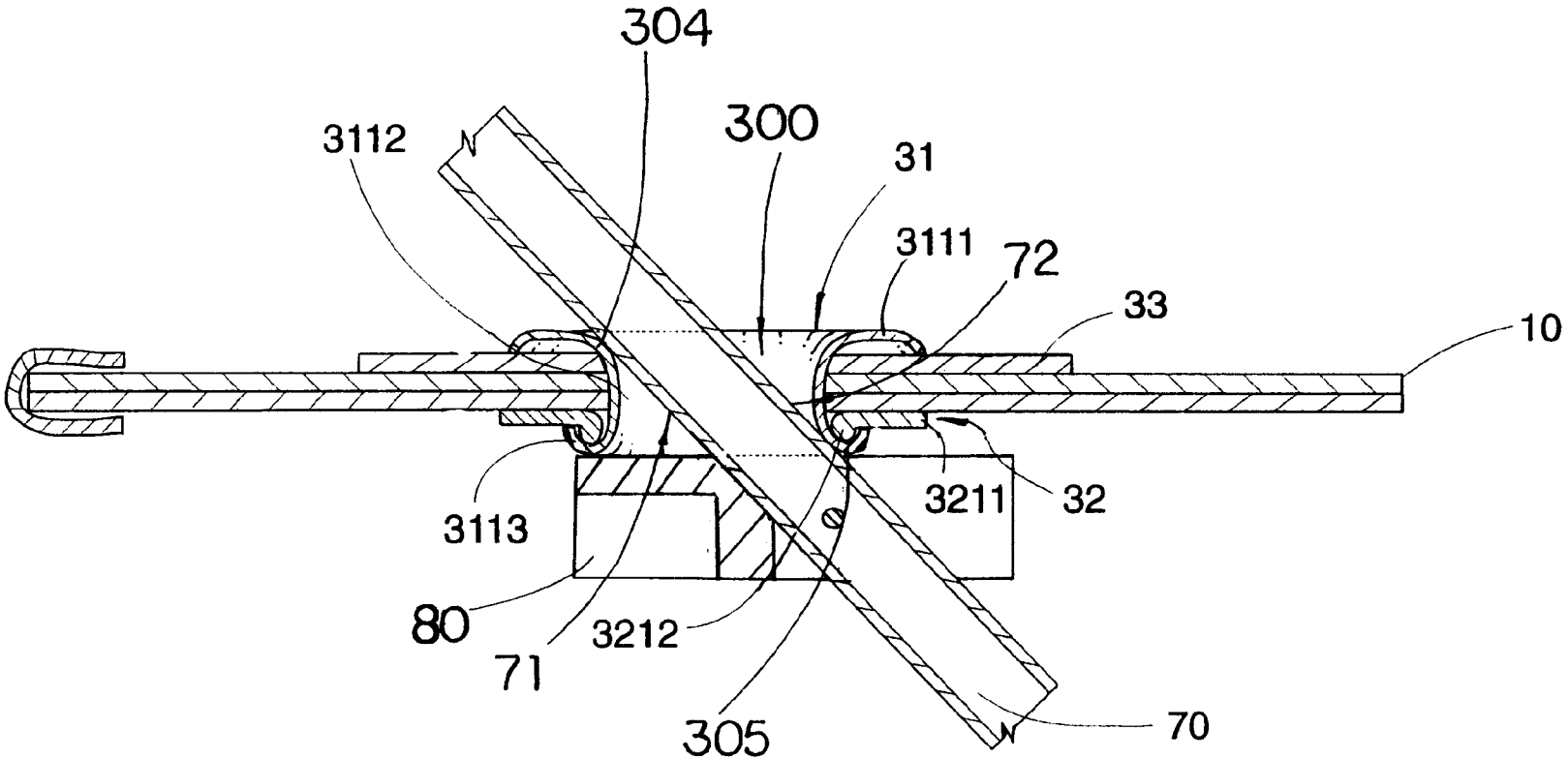
FIG. 4 is a sectional side view of the support ring for holding a fabric seat on an inclined chair frame tube according to the above-preferred embodiment of the present invention.

As shown in FIGS. 3 and 4, the upper ring member 31 comprises a holding ring plate 3111, a ring shaped shank 3112 integrally extended from an inner ring edge of the holding ring plate 3111 downwardly, and a bottom engaging rim 3113 integrally extended from the shank 3112 and adapted to bend outwardly to engage with the lower ring member 32 so as to form the support ring 30 and mount the support ring 30 around the tube placement hole 111 of the fabric seat 11. The size and shape of the shank 3112 is preferable equal to or slightly smaller than the tube placement hole 111 of the fabric seat 10.

The lower ring member 32 comprises an oval ring-shaped base plate 3211 having a central ring hole 3200 (as shown in FIG. 3) and an engagement ridge 3212 downwardly projected around the ring hole 3200 of base plate 3211. The ring hole 3200 has a size and shape preferably equal to that of the tube placement hole 111.

To mount the support ring 30 around the tube placement hole 111 of the fabric seat 10, as shown in FIGS. 3 and 4, the lower ring member 32 is first to place underneath the tube placement hole 111 so as to align the tube placement hole 111 with the ring hole 3200 coaxially. Second, insert the shank 3112 downwardly through the tube placement hole 111 until the holding ring plate 3111 pressing on the area around the tube placement hole 111 of the reinforcing patch 33 and the engaging rim 3113 downwardly extending out of the lower ring member 32. Finally, outwardly and radially bend the engaging rim 3113 to fold over the engagement ridge 3212 of the lower ring member 32, as shown in FIG. 4, so as to firmly connect the upper ring member 31 with the lower ring member 32 together to form the support ring 30 and to secure the support ring 30 on the fabric seat 10 by mounting around the respective tube placement hole 111 on the fabric seat 10, wherein a round edge around the tube placement hole 111 of the fabric seat is securely clamped between the upper ring member 31 and the lower ring member 32 by compressing the upper ring member 31 and the lower ring member 32 towards each other.

Figure 5:
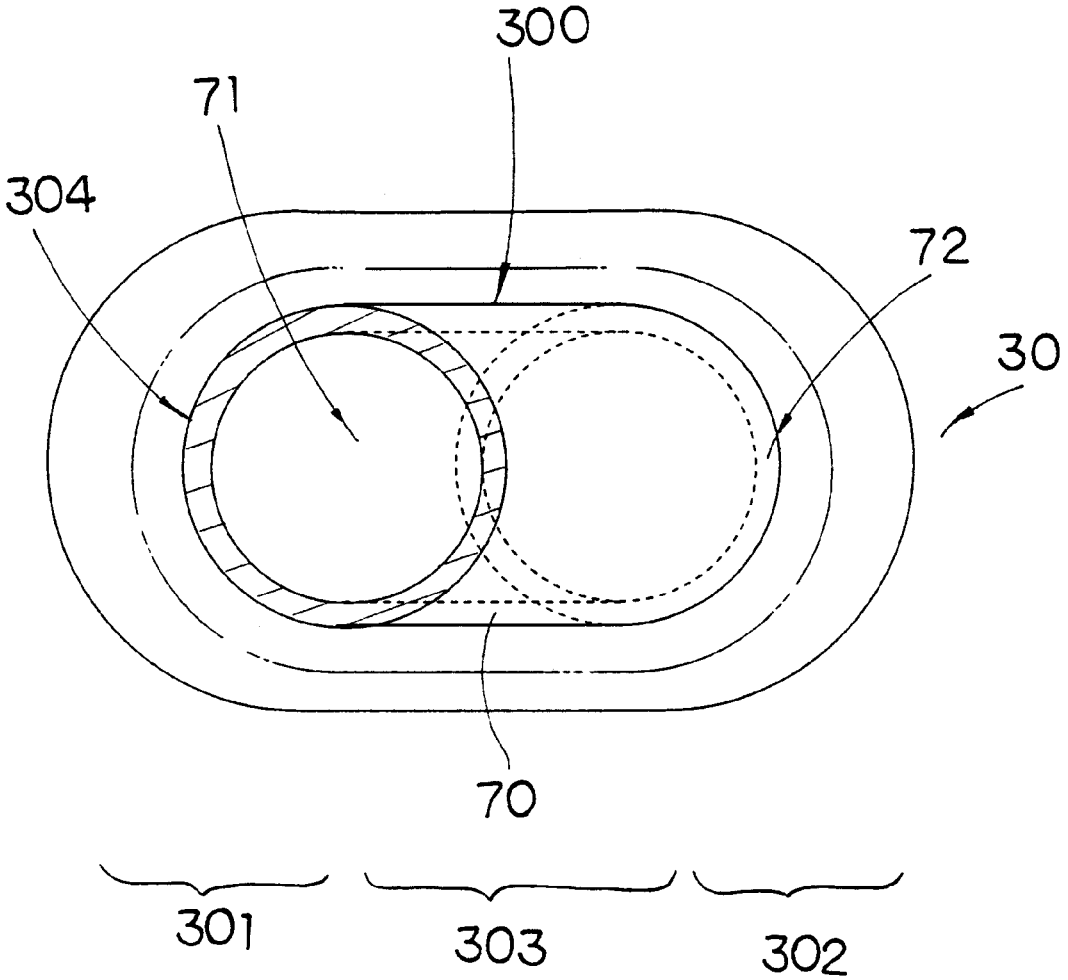
FIG. 5 is a schematic top view of the support ring having the inclined frame tube passing through according to the above-preferred embodiment of the present invention.

As shown in FIGS. 2 to 5, the support ring 30 mounted on a corner portion the fabric seat 10 according to the present invention is adapted for holding the fabric seat 10 on the inclined frame tube 70 of a chair frame, wherein the inclined frame tube 70 is a round tube arranged to be inclined with respect to the horizontally supported fabric seat 10 as shown in FIGS. 2 and 4. The support ring 30 has a supporting hole 300 contributed by two semi-circular portions 301, 302 and an intermediate portion 303 extended between the two semi-circular portions 301, 302 (as shown in FIG. 5).

Each of the semi-circular portions 301, 302 has a diameter equal to or slightly larger than a diameter of the inclined frame tube 70. As shown in FIGS. 4 and 5, the intermediate portion 303 also has a width equal to the diameter of the semi-circular portion 301, 302. When the inclined frame tube 70 fittingly passes through the supporting hole and is supported inclinedly with respect to the horizontal, the support ring 30 is horizontally held on the inclined frame tube 70 while a lower half of the frame tube 71 resting on an upper edge 304 of one of the semi-circular portion 301 of the supporting hole 300 and an upper half 72 of the frame tube 70 supporting by a lower edge 305 of the another semi-circular portion 302 of the supporting hole 300. So that the support ring 30 can be horizontally rested on a seat joint 80 which is riveted on the inclined frame tube 70, as shown in FIGS. 2 to 4. Therefore, the fabric seat 10 can be mounted horizontally on the chair frame and the downwardly force applied on the fabric seat 10 can be evenly distributed and supported around the support ring 30.

Accordingly, raised points near each support ring 30 and stress points along the edges of each support ring 30 are eliminated. The shape and size of the support ring 30 is the same shape and size as a cross-section of the inclined frame tube 70, as shown in FIG. 5, so that the inclined frame tube 70 may only rotate between a vertical position and an inclined position as shown in FIG. 4.

In view of above, the support ring 30 of the present invention can substantially achieve the following features:

1. The support ring 30 is adapted for the lining of the tube placement hole 111 of the fabric seat 10 for attaching the fabric seat 10 to the chair frame by sliding the support ring 30 over the respective inclined frame tube 70 of the chair frame in a manner as to allow the support ring 30 to rest horizontally on the inclined frame tube 70 so as to enable the fabric seat 10 also resting horizontally on the chair frame.

2. It can evenly distribute the stress around the support ring 30 so as to minimize the deterioration of the tube placement hole 111 of the fabric seat 10 as the portable chair is used.

3. It can limit damage to the area around the tube placement hole 111 of the fabric seat 10 as the portable chair is used.

4. It can reduce the horizontal strain on the tube placement hole 111 from being pulled against the inclined frame tube 70 by transferring some of the force to vertical pressure by the support ring 30 against the inclined frame tube 70.

What is claimed is:

1. A support ring mounted on a corner portion of a fabric seat for holding said fabric seat on an inclined frame tube of a chair frame, said support ring having a supporting hole contributed by two semi-circular portions and an intermediate portion extended between said two semi-circular portions, said intermediate portion having a width at least equal to a diameter of each of said semi-circular portions, thereby said supporting ring is adapted for said inclined frame tube passing therethrough for supporting said fabric seat inclinedly with respect to horizontal, and said support ring is arranged for horizontally holding on said inclined frame tube while a lower half of said frame tube resting on an upper edge of one of said semi-circular portion of said supporting hole and an upper half of said frame tube supporting below a lower edge of another said semi-circular portion of said supporting hole, so as to hold said fabric seat horizontally on said chair frame.

2. The support ring as recited in claim 1 wherein said support ring is mounted on a tube placement hole formed at one of a front corner of said fabric seat.

3. The support ring as recited in claim 2 wherein said support ring comprises an oval upper ring member and an oval lower ring member, wherein said upper ring member comprises a holding ring plate, a ring shaped shank integrally extended from an inner ring edge of said holding ring plate downwardly, and a bottom engaging rim integrally extended from said shank and adapted to bend outwardly to engage with said lower ring member so as to form said support ring and mount said support ring around said tube placement hole of said fabric seat.

4. The support ring as recited in claim 3 wherein said lower ring member comprises an oval ring-shaped base plate having a central ring hole and an engagement ridge downwardly projected around said ring hole of said base plate, wherein said engaging rim, which is downwardly extended out of said lower ring member, is outwardly and radially bent to fold over said engagement ridge of said lower ring member so as to firmly connect said upper ring member with said lower ring member together to form said support ring and to secure said support ring on said fabric seat by mounting around said respective tube placement hole on said fabric seat, wherein a round edge around said tube placement hole of said fabric seat is securely clamped between said upper ring member and said lower ring member by compressing said upper ring member and said lower ring member towards each other.

5. The support ring as recited in claim 2 wherein a reinforcing patch is stitched on said front corner of said fabric seat around said tube placement hole for reinforcing a structural integrity of said tube placement hole.

6. The support ring as recited in claim 5 wherein said support ring comprises an oval upper ring member and an oval lower ring member, wherein said upper ring member comprises a holding ring plate, a ring shaped shank integrally extended from an inner ring edge of said holding ring plate downwardly, and a bottom engaging rim integrally extended from said shank and adapted to bend outwardly to engage with said lower ring member so as to form said support ring and mount said support ring around said tube placement hole of said fabric seat.

7. The support ring as recited in claim 6 wherein said lower ring member comprises an oval ring-shaped base plate having a central ring hole and an engagement ridge downwardly projected around said ring hole of said base plate, wherein said engaging rim, which is downwardly extended out of said lower ring member, is outwardly and radially bent to fold over said engagement ridge of said lower ring member so as to firmly connect said upper ring member with said lower ring member together to form said support ring and to secure said support ring on said fabric seat by mounting around said respective tube placement hole on said fabric seat, wherein a round edge around said tube placement hole of said fabric seat is securely clamped between said upper ring member and said lower ring member by compressing said upper ring member and said lower ring member towards each other.

8. The support ring as recited in claim 1 wherein said support ring comprises an oval upper ring member and an oval lower ring member, wherein said upper ring member comprises a holding ring plate, a ring shaped shank integrally extended from an inner ring edge of said holding ring plate downwardly, and a bottom engaging rim integrally extended from said shank and bent outwardly to engage with said lower ring member so as to form said support ring and mount said support ring on said corner portion of said fabric seat.

9. The support ring as recited in claim 8 wherein said lower ring member comprises an oval ring-shaped base plate having a central ring hole and an engagement ridge downwardly projected around said ring hole of said base plate, wherein said engaging rim, which is downwardly extended out of said lower ring member, is outwardly and radially bent to fold over said engagement ridge of said lower ring member so as to firmly connect said upper ring member with said lower ring member together to form said support ring and to secure said support ring on said fabric seat by mounting around a tube placement hole provided on said corner portion of said fabric seat, wherein a round edge around said tube placement hole of said fabric seat is securely clamped between said upper ring member and said lower ring member by compressing said upper ring member and said lower ring member towards each other.

10. A support ring mounted on a corner portion of a fabric seat wherein an inclined frame tube is arranged to be inclined with respect to said fabric seat for holding said fabric seat on said inclined frame tube, said support ring having a supporting hole contributed by two semi-circular portions and an intermediate portion extended between said two semi-circular portions, each of said semi-circular portions having a diameter at least equal to a diameter of said inclined frame tube, said intermediate portion also having a width at least equal to said diameter of said semi-circular portion, wherein when said inclined frame tube fittingly passes through said supporting hole and is supported inclinedly with respect to horizontal, said support ring is horizontally held on said inclined frame tube while a lower half of said frame tube resting on an upper edge of one of said semi-circular portion of said supporting hole and an upper half of said frame tube supporting below a lower edge of another said semi-circular portion of said supporting hole.

11. The support ring as recited in claim 10 wherein said support ring is mounted on a tube placement hole formed at one of a front corner of said fabric seat.

12. The support ring as recited in claim 11 wherein a reinforcing patch is stitched on said front corner of said fabric seat around said tube placement hole for reinforcing a structural integrity of said tube placement hole.

13. The support ring as recited in claim 12 wherein said support ring comprises an oval upper ring member and an oval lower ring member, wherein said upper ring member comprises a holding ring plate, a ring shaped shank integrally extended from an inner ring edge of said holding ring plate downwardly, and a bottom engaging rim integrally extended from said shank and adapted to bend outwardly to engage with said lower ring member so as to form said support ring and mount said support ring around said tube placement hole of said fabric seat.

14. The support ring as recited in claim 13 wherein said lower ring member comprises an oval ring-shaped base plate having a central ring hole and an engagement ridge downwardly projected around said ring hole of said base plate, wherein said engaging rim, which is downwardly extended out of said lower ring member, is outwardly and radially bent to fold over said engagement ridge of said lower ring member so as to firmly connect said upper ring member with said lower ring member together to form said support ring and to secure said support ring on said fabric seat by mounting around said respective tube placement hole on said fabric seat, wherein a round edge around said tube placement hole of said fabric seat is securely clamped between said upper ring member and said lower ring member by compressing said upper ring member and said lower ring member towards each other.

15. The support ring as recited in claim 10 wherein said support ring comprises an oval upper ring member and an oval lower ring member, wherein said upper ring member comprises a holding ring plate, a ring shaped shank integrally extended from an inner ring edge of said holding ring plate downwardly, and a bottom engaging rim integrally extended from said shank and bent outwardly to engage with said lower ring member so as to form said support ring and mount said support ring on said corner portion of said fabric seat.

16. The support ring as recited in claim 15 wherein said lower ring member comprises an oval ring-shaped base plate having a central ring hole and an engagement ridge downwardly projected around said ring hole of said base plate, wherein said engaging rim, which is downwardly extended out of said lower ring member, is outwardly and radially bent to fold over said engagement ridge of said lower ring member so as to firmly connect said upper ring member with said lower ring member together to form said support ring and to secure said support ring on said fabric seat by mounting around a tube placement hole provided on said corner portion of said fabric seat, wherein a round edge around said tube placement hole of said fabric seat is securely clamped between said upper ring member and said lower ring member by compressing said upper ring member and said lower ring member towards each other.

17. The support ring as recited in claim 11 wherein said support ring comprises an oval upper ring member and an oval lower ring member, wherein said upper ring member comprises a holding ring plate, a ring shaped shank integrally extended from an inner ring edge of said holding ring plate downwardly, and a bottom engaging rim integrally extended from said shank and adapted to bend outwardly to engage with said lower ring member so as to form said support ring and mount said support ring around said tube placement hole of said fabric seat.

18. The support ring as recited in claim 17 wherein said lower ring member comprises an oval ring-shaped base plate having a central ring hole and an engagement ridge downwardly projected around said ring hole of said base plate, wherein said engaging rim, which is downwardly extended out of said lower ring member, is outwardly and radially bent to fold over said engagement ridge of said lower ring member so as to firmly connect said upper ring member with said lower ring member together to form said support ring and to secure said support ring on said fabric seat by mounting around said respective tube placement hole on said fabric seat, wherein a round edge around said tube placement hole of said fabric seat is secured clamped between said upper ring member and said lower ring member by compressing said upper ring member and said lower ring member towards each other.

* * * * *